US006453558B1

(12) United States Patent
Baldwin

(10) Patent No.: US 6,453,558 B1
(45) Date of Patent: Sep. 24, 2002

(54) METHOD OF LOCKING TOGETHER EXHAUST COMPONENTS

(75) Inventor: Freddie A. Baldwin, Columbus, IN (US)

(73) Assignee: ArvinMeritor, Inc., Troy, MI (US)

( * ) Notice: Subject to any disclaimer, the term of this patent is extended or adjusted under 35 U.S.C. 154(b) by 0 days.

(21) Appl. No.: 09/827,418

(22) Filed: Apr. 6, 2001

(51) Int. Cl.[7] ..... B21D 51/16

(52) U.S. Cl. ..... 29/890.08; 29/890.043; 29/511; 29/513

(58) Field of Search ..... 29/890.08, 890.043, 29/509, 510, 511, 512, 513, 521; 72/370.06, 370.07, 370.1; 403/279, 282, 285; 285/222, 382.4

(56) References Cited

U.S. PATENT DOCUMENTS

| | | | | |
|---|---|---|---|---|
| 1,996,346 | A | | 4/1935 | Mueller |
| 2,164,629 | A | * | 7/1939 | Sibley |
| 3,342,366 | A | * | 9/1967 | Defauw |
| 3,918,625 | A | * | 11/1975 | Nippert |
| 4,192,531 | A | * | 3/1980 | Williams et al. |
| 4,195,943 | A | * | 4/1980 | Williams |
| 4,233,726 | A | * | 11/1980 | Williams |
| 4,649,894 | A | * | 3/1987 | Hoeffken |
| 4,961,314 | A | | 10/1990 | Howe et al. |
| 5,009,095 | A | * | 4/1991 | Voss |
| 5,251,370 | A | * | 10/1993 | Muller et al. |
| 5,290,974 | A | | 3/1994 | Douglas et al. |
| 5,498,091 | A | * | 3/1996 | Chan |
| 5,575,330 | A | * | 11/1996 | Hoeffken |
| 5,801,344 | A | | 9/1998 | Herold |

OTHER PUBLICATIONS

Ellsworth, Royce Lee; Myron, Eugene Walker; and Wood, David Terril. Method of coupling exhaust components to one another. Pat. Appl. No. 09/627,500.

* cited by examiner

*Primary Examiner*—I Cuda-Rosenbaum
*Assistant Examiner*—T. Nguyen
(74) *Attorney, Agent, or Firm*—Barnes & Thornburg

(57) ABSTRACT

A method of assembling exhaust components comprising the steps of: (a) providing an exhaust plate or other exhaust component having a first side, a second side, and an embossment, the embossment defining an aperture and a void contiguous with the aperture; (b) providing an exhaust pipe or other mating exhaust component having an end portion having a leading end, the end portion sized to be received by the void; (c) inserting the end portion of the exhaust pipe into the void; and (d) bending a portion of the embossment over the leading end of the end portion to lock the exhaust plate to the exhaust pipe. Step (d) may include flaring the embossment and a leading portion of the end portion of the exhaust pipe. Step (d) may be performed by punching the embossment to deform the embossment and the leading portion of the end portion of the exhaust pipe. The punch may be aligned with the embossment and with a passage defined by the exhaust pipe and punching the embossment to bend the portion of the embossment over the leading end of the end portion and into the passage and desirably also to flare the embossment and the leading portion of the exhaust pipe. The method also may include the step of forming the embossment, the aperture and the void in the exhaust component with a tool prior to step (a).

17 Claims, 2 Drawing Sheets

METHOD OF LOCKING TOGETHER EXHAUST COMPONENTS

BACKGROUND AND SUMMARY OF THE INVENTION

This invention relates to exhaust system manufacturing and more particularly to a method of mechanically locking components of exhaust treatment devices.

Many exhaust treatment devices, including mufflers and after-treatment devices, are formed from multiple components which are coupled together. An exhaust treatment device often includes a pipe component which passes through another component and is coupled thereto. In common configurations of vehicle mufflers, for example, a louvered pipe passes through apertures formed in baffle plates enclosed in a muffler shell. The louvered pipe is coupled to the baffle plate during assembly and manufacture of the muffler. Exhaust treatment devices are disclosed in Herold, U.S. Pat. No. 5,801,344, issued Sep. 1, 1998, and Howe et al., U.S. Pat. No. 4,961,314, issued Oct. 9, 1990, which are hereby incorporated by reference herein.

Another exhaust system is disclosed in pending U.S. application Ser. No. 09/627,500, entitled "Method of Coupling Exhaust Components To One Another", which is also incorporated by reference herein. The exhaust system includes a method of assembling exhaust components that includes, among other things, the steps of providing an exhaust component with an aperture and providing a mating exhaust component having an end sized to be received through the aperture. A stop is formed on the mating exhaust component which will serve as a first half of a coupling mechanism prior to insertion of the mating exhaust component in the aperture of the exhaust component. The end of the mating exhaust component is urged through the aperture in the exhaust component until the stop engages the exhaust component and is simultaneously deformed to form a second half of the coupling mechanism. The components of such an exhaust device may be coupled by forming a stop on the exterior of a component to be inserted through an aperture in second component prior to insertion of the first component. In certain embodiments, the first component is a pipe and the second component is a baffle plate. The pipe is inserted through the aperture formed in the baffle plate until the stop contacts a first wall of the baffle plate. After the stop engages the first wall of the baffle plate, the end of the pipe extends only slightly beyond a second wall of the baffle plate. The end of the pipe is flared until the flared end contacts the second wall of the baffle plate, thereby mechanically locking the two components.

Although the method of the exhaust system referred to above provides several advantages over existing coupling or locking systems, the method in accordance with the present invention is more efficient and effective than the above method and other heretofore known existing methods. The method of the present invention provides a stronger and more durable bond than existing methods for coupling or locking together exhaust components, and is easier and less expensive to use than existing methods. Additionally, the tooling that can be used to perform the method in accordance with the present invention is more economical and more durable than tooling used in connection with existing methods. Moreover, the method of the present invention can be readily used with exhaust pipes having small diameters, such as those having diameters less than 1½ inches, and still provide a strong and durable bond.

In accordance with these and other objects, the present invention provides a method of assembling exhaust components comprising the steps of: (a) providing an exhaust plate or other exhaust component having a first side, a second side, and an embossment, the embossment defining an aperture and a void contiguous with the aperture; (b) providing an exhaust pipe or other mating exhaust component having an end portion including a leading end, the end portion sized to be received by the void; (c) inserting the end portion of the exhaust pipe into the void; and (d) bending a portion of the embossment over the leading end of the end portion to lock the exhaust plate to the exhaust pipe. Desirably, step (d) includes flaring the embossment and a leading portion of the end portion of the exhaust pipe. The method also may include the step of forming the embossment in the exhaust component prior to step (a). The forming step may include punching the exhaust plate with a tool to form the embossment in the exhaust component.

In a preferred embodiment, step (d) is performed by punching the embossment with a punch to deform the embossment and the leading portion of the end portion of the exhaust pipe. The punch may be aligned with the embossment and with a passage defined by the exhaust pipe and punching the embossment bends a portion of the embossment over the leading end of the end portion and into the passage and desirably also flares outwardly the embossment and the leading portion of the exhaust pipe. The aperture desirably is generally circular and the embossment is disposed substantially about the aperture. The void desirably is generally cylindrical to receive the exhaust pipe.

Accordingly, the method of locking together exhaust components in accordance with a preferred embodiment causes a strong and durable coupling between the components. Moreover, the method is efficient and inexpensive and does not require a mandrel to expand any components; rather, a single punch causes the components to lock together in accordance with a preferred embodiment. Still further, the method can readily be used with pipes having diameters less than 1½".

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
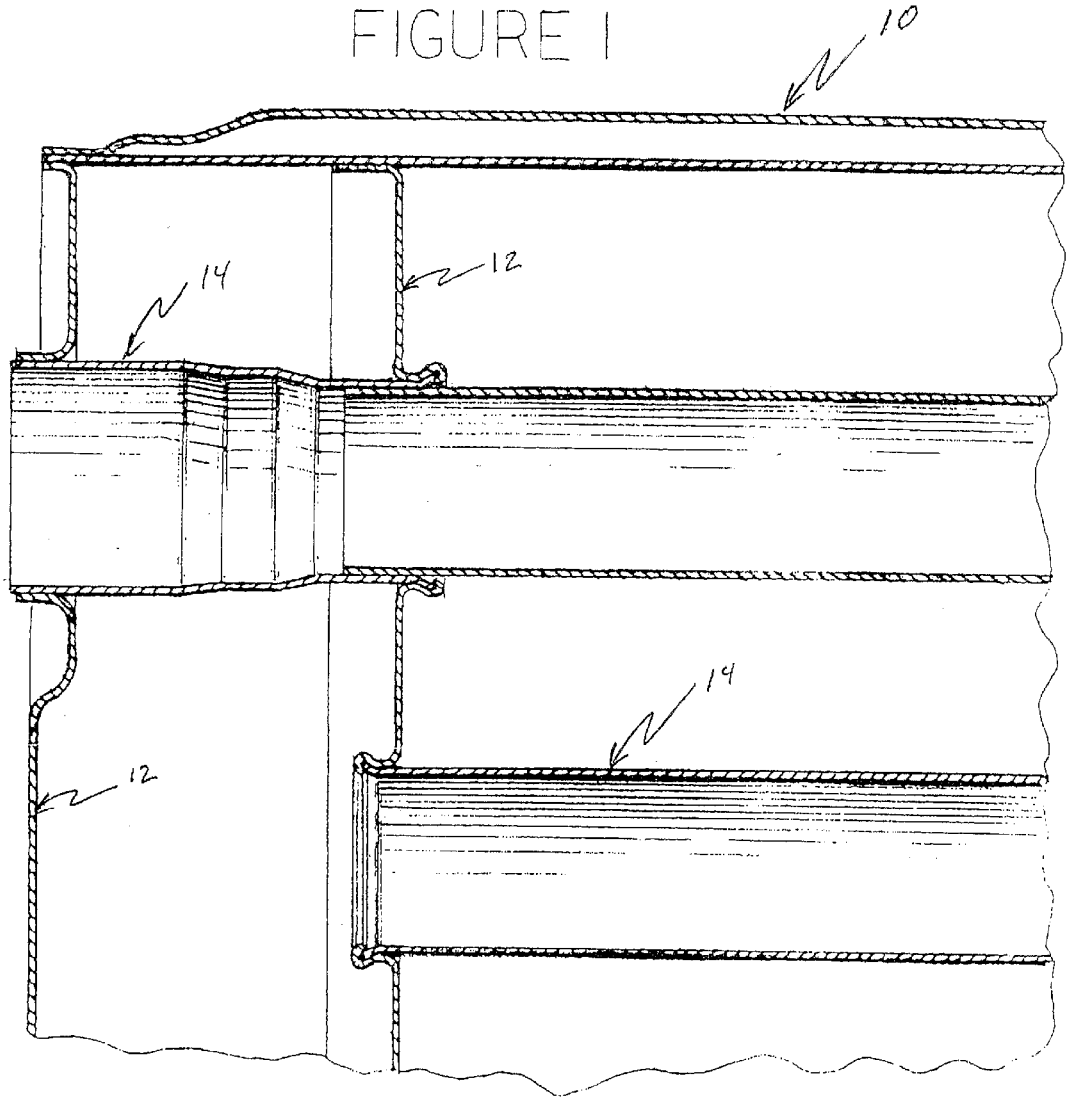
FIG. 1 is a broken sectional view, schematic in nature, of an exhaust treatment device in the form of a muffler including a plurality of exhaust components and mating exhaust components locked together by a method in accordance with a preferred embodiment of the present invention.

FIG. 1 illustrates an example of an exhaust treatment device or processor 10 that includes a plurality of exhaust components 12 and a plurality of mating exhaust components 14 locked together in accordance with a preferred embodiment of the invention. The exhaust treatment device 10 may be in the form of a muffler as illustrated in FIG. 1, or, alternatively, may have any other suitable configuration or construction. The exhaust treatment device 10 may also have any suitable number and arrangement of exhaust components 12 and mating exhaust components 14. Similarly, the exhaust components 12 and mating exhaust components 14 themselves may have any suitable configuration or construction.

FIGS. 2–5 illustrate a method for locking one of the exhaust components 12 to one of the mating exhaust components 14 of FIG. 1 in accordance with a preferred embodiment of the invention. In FIGS. 2–5, the exhaust component and mating exhaust component are illustrated in the form of, respectively, an exhaust plate in the form of a baffle plate 18 and an exhaust pipe 20.

Figure 2:
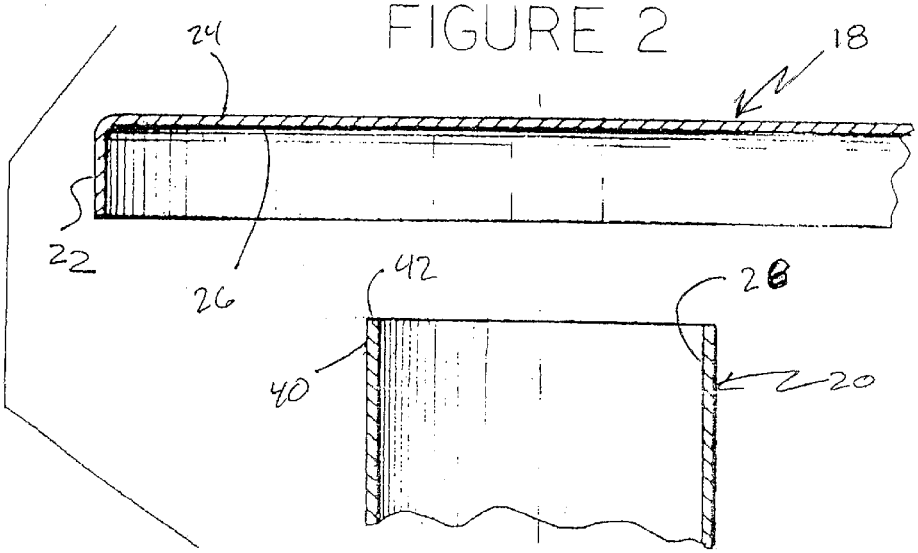
FIG. 2 is a broken sectional view, schematic in nature, of one of the exhaust pipes and one of the exhaust baffle plates of FIG. 1 in an initial stage before being locked together.

FIG. 2 illustrates the baffle plate 18 and the exhaust pipe 20 in an initial uncoupled and undeformed stage. The baffle plate 18 and the exhaust pipe 20 may have any suitable configuration. In FIG. 2, for example, the baffle plate 18 is illustrated as initially being generally flat with an outer lip 22, and includes a first side 24 and a second side 26. The exhaust pipe 20 is illustrated as being generally cylindrical and defines a generally cylindrical passage 28.

Figure 3:
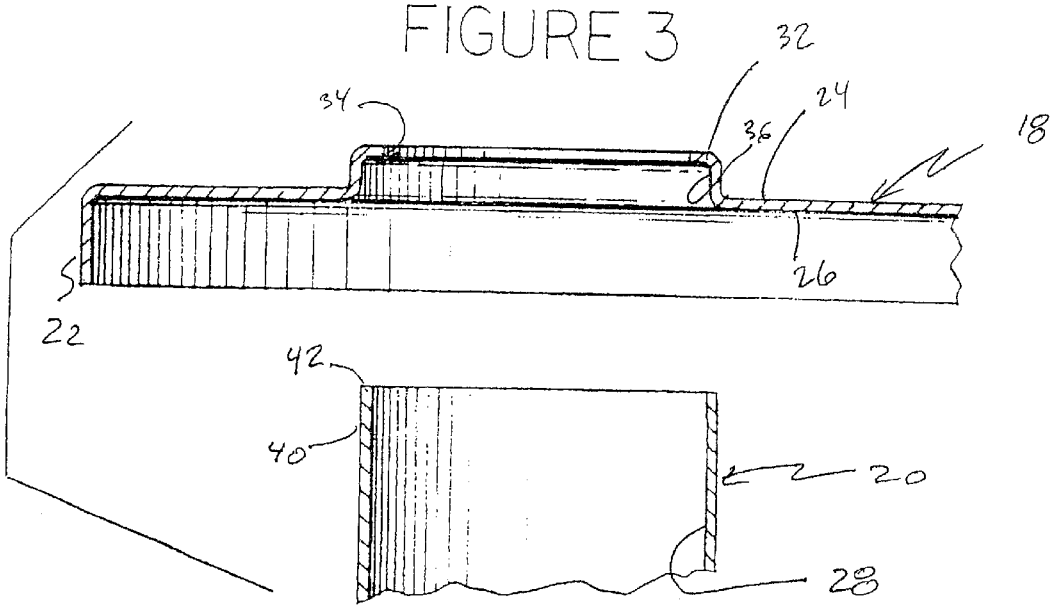
FIG. 3 is a view similar to FIG. 2 after the exhaust baffle plate has been deformed to include an embossment and to define an aperture and a void.

FIG. 3 illustrates the baffle plate 18 after it has been deformed to form an embossment 32 and to define an aperture 34 and a void 36 contiguous with the aperture. The embossment 32 may have any suitable configuration and construction. In the illustrated embodiment, the embossment 32 is generally circular, and includes an L-shaped cross section and is disposed substantially about the aperture 34. In accordance with alternative embodiments, the embossment 32 may instead have any other suitable configuration or cross section. The embossment 32 may, if desired, extend less than completely around the aperture 34. Desirably, the aperture 34 is generally circular, and the void 36 is generally cylindrical. The embossment 32 may be formed in any suitable manner such as, for example, by a punch tool (not shown) that forms the embossment and void 36 and pierces the baffle plate 18 to define the aperture 34 with a single stroke of the tool.

Figure 4:
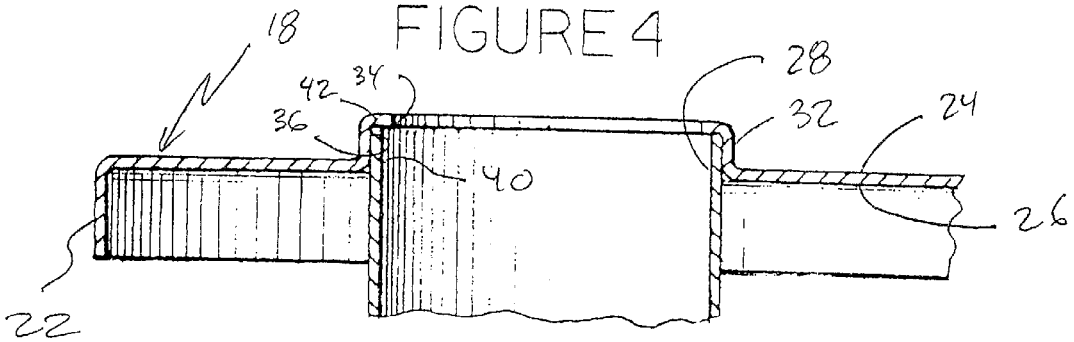
FIG. 4 is a view similar to FIG. 3 showing the end portion of the exhaust pipe received by the void defined by the exhaust baffle plate.

FIG. 4 illustrates an end portion 40 of the exhaust pipe 20 inserted into the void 36 defined by the baffle plate 18. A leading end 42 of the exhaust pipe 20 desirably is contacting the second side 26 of the baffle plate 18.

Figure 5:
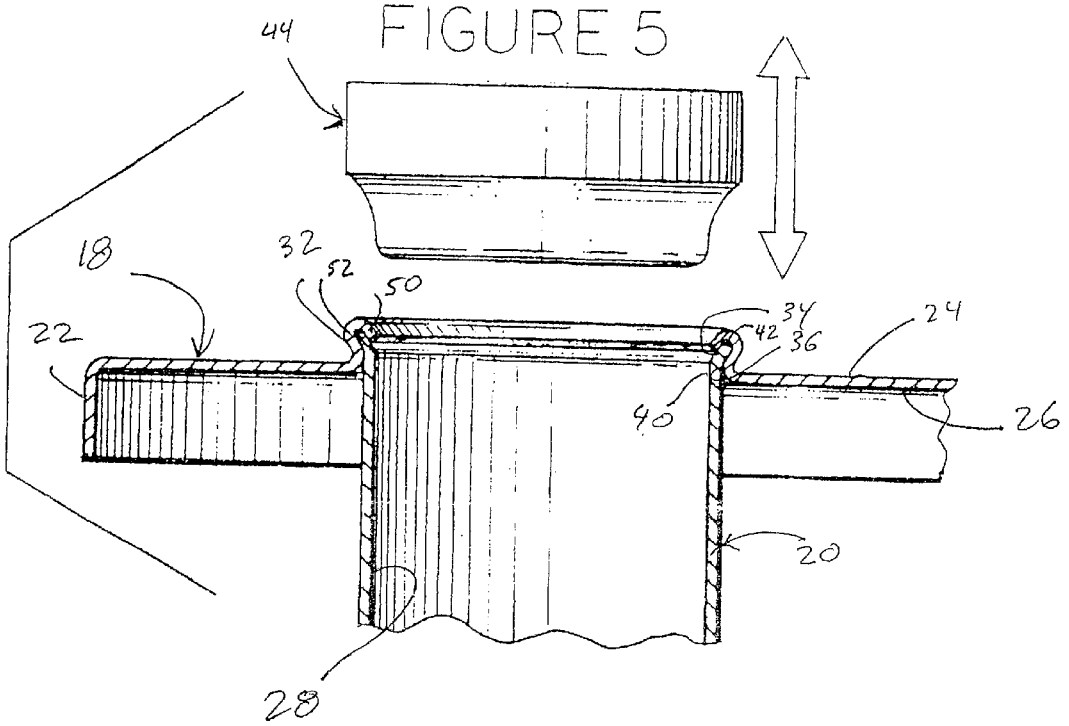
FIG. 5 is a view similar to FIG. 4 after the embossment has been punched causing the embossment and the leading portion of the exhaust pipe to be deformed to thereby lock together the exhaust baffle plate and the exhaust pipe.

FIG. 5 illustrates the baffle plate 18 and the exhaust pipe 20 after they have been punched by a tool 44 to lock together the baffle plate and exhaust pipe. Desirably, the tool 44 is aligned generally with the embossment 32 and passage 28 of the exhaust pipe 20 and punches the first side 24 of the embossment 32. Punching of the embossment 32 causes the embossment and the leading end 42 of the exhaust pipe 20 to deform, thereby locking together the baffle plate 18 and the exhaust pipe. In the illustrated embodiment, punching desirably causes a portion 50 of the embossment 32 to bend over the leading end 42 of the exhaust pipe 20 and into the passage 28, and also causes the embossment 32 and a leading portion 52 of the end portion 40 to flare generally outwardly. Thus, FIG. 5 illustrates an example of the baffle plate 18 and the exhaust pipe 20 locked together by a method in accordance with a preferred embodiment of the invention.

Accordingly, the invention in accordance with a preferred embodiment provides an efficient and cost effective method for locking together exhaust components that results in a strong and durable lock. The tooling necessary to achieve the method is minimal and the method can be performed in minimal steps. Moreover, because of the type of tooling required, if desired, the method also can readily be performed on pipes having diameters less than 1½".

Although the invention has been described in detail with reference to certain preferred embodiments, variations and modifications exist within the scope and spirit of the invention as described and defined in the following claims.

What is claimed is:

1. A method of locking together exhaust components, the method comprising the steps of:

(a) forming in a single punch stroke an exhaust component having a first side, a second side, and an embossment disposed substantially about a continuous generally circular aperture and having a void contiguous with the aperture;

(b) providing a mating exhaust component having an end portion including a leading end, the end portion sized to be received by the void;

(c) inserting the end portion of the mating exhaust component into the void; and (d) bending a portion of the embossment of the exhaust component over the leading end of the end portion of the mating exhaust component to lock the exhaust component to the mating exhaust component.

2. The method of claim 1 wherein the end portion of the mating exhaust component includes a leading portion and step (d) includes flaring the embossment and the leading portion.

3. The method of claim 1 wherein step (d) includes aligning a punch with a passage defined by the mating exhaust component and punching the embossment on the first side of the exhaust component.

4. The method of claim 3 wherein punching the embossment bends at least a portion of the embossment into the passage defined by the mating exhaust component.

5. The method of claim 4 wherein the end portion of the mating exhaust component includes a leading portion and punching the embossment flares the embossment and the leading portion.

6. The method of claim 1 wherein the forming step includes punching the exhaust component with a tool to form the embossment.

7. The method of claim 1 wherein step (d) includes deforming the embossment and a leading portion of the end portion of the mating exhaust component.

8. The method of claim 1 wherein during step (a) the embossment has an L-shaped cross section.

9. The method of claim 1 wherein the provided exhaust component is an exhaust baffle plate.

10. The method of claim 1 wherein the provided mating exhaust component is an exhaust pipe.

11. The method of claim 1 wherein the void is substantially cylindrical.

12. A method of locking together exhaust components, the method comprising the steps of:

(a) forming in a single punch stroke an exhaust plate having a first side, a second side, and an embossment defining a substantially circular continuous aperture and a substantially cylindrical void contiguous with the aperture, the embossment disposed substantially about the aperture;

(b) providing an exhaust pipe defining a passage and having an end portion that includes a leading portion and a leading end;

(c) inserting the end portion of the exhaust pipe into the void of the exhaust plate such that the leading end of the exhaust pipe contacts the embossment on the second side of the exhaust plate; and (d) aligning a punch with the passage and the embossment and punching the embossment to deform the embossment and the leading portion to lock the exhaust plate to the exhaust pipe.

13. The method of claim 12 wherein the punching during step (d) bends a portion of the embossment over the leading end of the end portion and into the passage and flares the embossment and the leading portion.

14. The method of claim 12 wherein during step (a) the embossment has an L-shaped cross section.

15. A method of locking together exhaust components, the method comprising the steps of:

(a) providing an exhaust plate having a first side and a second side, and an exhaust pipe defining a passage and having an end portion including a leading portion and a leading end;

(b) forming in the exhaust plate, in a single stroke, an embossment that defines a generally circular aperture and a generally cylindrical void contiguous with the aperture, the embossment disposed substantially about the aperture and having an L-shaped cross section;

(c) inserting the end portion of the exhaust pipe into the void such that the leading end contacts the embossment on the second side of the exhaust plate; and (d) aligning a punch with the passage and the embossment and punching the embossment on the first side of the exhaust plate to deform the embossment and the leading portion to lock the exhaust plate with the exhaust pipe.

16. The method of claim 15 wherein the punching during step (d) bends a portion of the embossment over the leading end of the end portion, and flares the embossment and the leading portion.

17. The method of claim 15 wherein step (b) is performed by punching the exhaust plate with a tool that forms the embossment.

* * * * *